US007017303B2

(12) United States Patent
Cho

(10) Patent No.: US 7,017,303 B2
(45) Date of Patent: Mar. 28, 2006

(54) VEHICLE DOOR WINDOW GLASS REGULATOR ASSEMBLY USING A STOP BAR

(75) Inventor: Eui-Chan Cho, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/749,252

(22) Filed: Dec. 30, 2003

(65) Prior Publication Data

US 2005/0055882 A1 Mar. 17, 2005

(30) Foreign Application Priority Data

Sep. 16, 2003 (KR) ..... 10-2003-0064177

(51) Int. Cl.
*E05F 11/44* (2006.01)

(52) U.S. Cl. ..... 49/351; 49/349

(58) Field of Classification Search ..... 49/348, 49/349, 350, 351, 324, 374
See application file for complete search history.

(56) References Cited

U.S. PATENT DOCUMENTS 1,130,189 A * 3/1915 Munch ..... 16/200
4,069,616 A * 1/1978 Doveinis ..... 49/103
4,924,627 A * 5/1990 Lam et al. ..... 49/351
5,027,555 A 7/1991 Halliwell
5,201,144 A * 4/1993 Krajenke ..... 49/351
5,243,785 A * 9/1993 Nieboer et al. ..... 49/375
5,497,578 A * 3/1996 Wautelet et al. ..... 49/349
5,595,025 A * 1/1997 MacPhail-Fausey ..... 49/351
6,295,762 B1 * 10/2001 Nemoto ..... 49/374

FOREIGN PATENT DOCUMENTS

JP 09-013791 1/1997

* cited by examiner

*Primary Examiner*—Gregory J. Strimbu
(74) *Attorney, Agent, or Firm*—Morgan Lewis & Bockius LLP

(57) ABSTRACT

A vehicle door window glass regulator assembly that enables a window to ascend and descend silently without generating unwanted noise, thereby providing passenger comfort and a feeling of elegance to the vehicle. In one embodiment of the present invention, a vehicle door window glass regulator assembly may comprise a lifting arm and a glass rail slidably connected to the lifting arm, whereby vertical movement of the glass rail may be effected by rotary motion of the lifting arm. An auxiliary arm may also be hinged to the lifting arm and slidably connected to the glass rail. A support rail may slidably support the auxiliary arm. Two sliders may slidably connect the lifting arm and the auxiliary arm to the glass rail. A non-elastic stop bar may be slidably inserted into the glass rail and the two sliders, and connecting mechanism may connect the stop bar to one of the two sliders.

3 Claims, 3 Drawing Sheets

VEHICLE DOOR WINDOW GLASS REGULATOR ASSEMBLY USING A STOP BAR

CROSS-REFERENCE TO RELATED APPLICATIONS

This application claims priority of Korean Application No. 10-2003-0064177, filed on Sep. 16, 2003, the disclosure of which is incorporated fully herein by reference.

FIELD OF THE INVENTION

The present invention relates to a door window glass regulator assembly for a vehicle and, more particularly, to a window glass regulator assembly that enables a window to ascend and descend silently without generating unwanted noise.

BACKGROUND OF THE INVENTION

A door window glass regulator assembly may be designed to enable a window to ascend and descend according to a passenger's need. The operation of the assembly may be silent, reducing discomfort to the passengers and providing a feeling of elegance to the vehicle.

SUMMARY OF THE INVENTION

Embodiments of the present invention relate to a door window glass regulator assembly for a vehicle that enables a window to silently ascend and descend and suppress unwanted noise, thus providing comfort to the passengers and a feeling of elegance to the vehicle.

In accordance with an exemplary embodiment of the present invention, a door window glass regulator assembly for a vehicle may comprise a lifting arm and a glass rail slidably connected to the lifting arm, whereby vertical movement of the glass rail may be effected by rotary motion of the lifting arm. An auxiliary arm may also be hinged to the lifting arm and slidably connected to the glass rail. A support rail may slidably support the auxiliary arm. Two sliders may slidably connect the lifting arm and the auxiliary arm to the glass rail. A stop bar may be slidably inserted into the glass rail and the two sliders, and connecting means may connect the stop bar to one of the two sliders.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENT

The preferred embodiment of the present invention will now be described in detail with reference to the annexed drawings.

Figure 1:
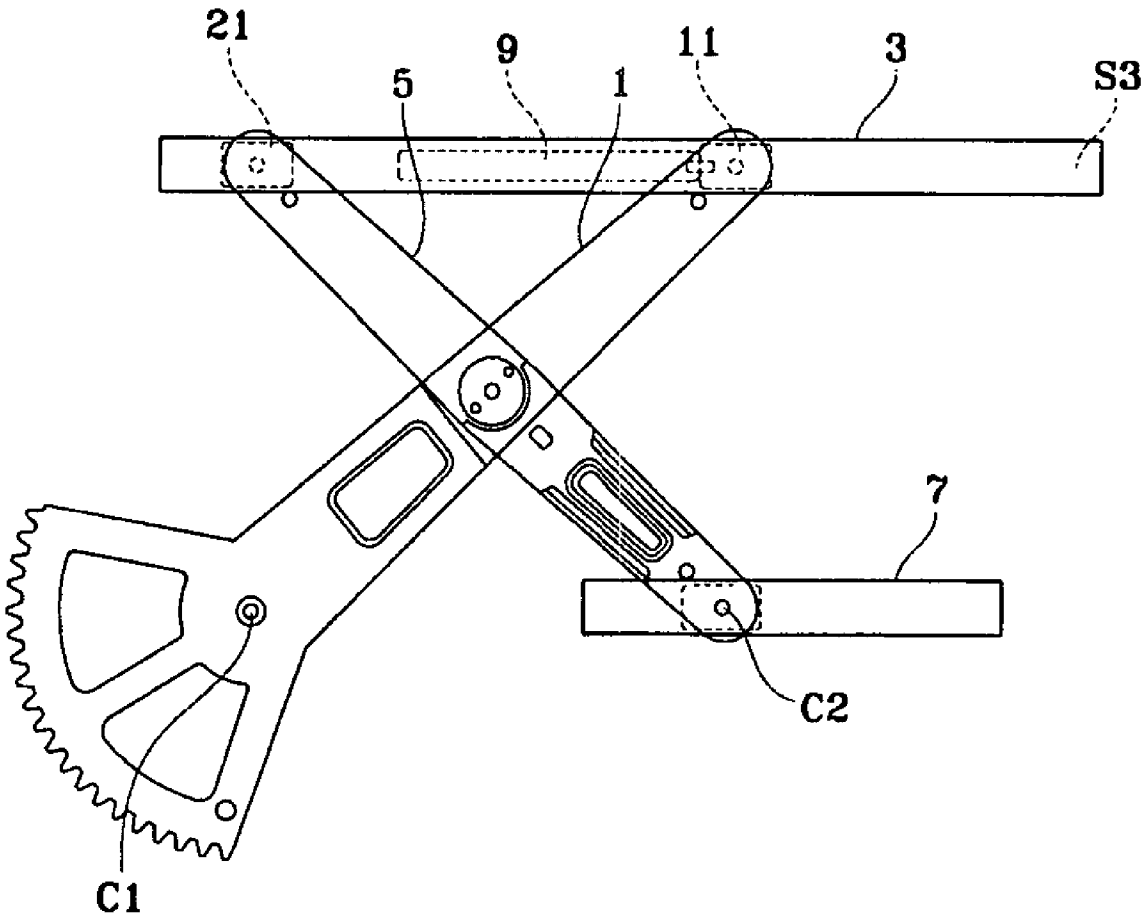
FIG. 1 is a schematic drawing for illustrating a door window glass regulator assembly for a vehicle according to an embodiment of the present invention.

As shown in FIG. 1, the door window glass regulator assembly for a vehicle includes a lifting arm 1 rotated by a regulator motor (not shown), a glass rail 3 slidably connected to the lifting arm 1 for vertical movement by rotating motion of the lifting arm 1, an auxiliary arm 5 hinged to the lifting arm 1 and slidably connected to the glass rail 3, a support rail 7 for slidably supporting the auxiliary arm 5, two sliders for slidably connecting the lifting arm 1 and the auxiliary arm 5 to the glass rail 3, and a stop bar 9 slidably inserted into a gap formed between the glass rail 3 and the two sliders.

Figure 4:
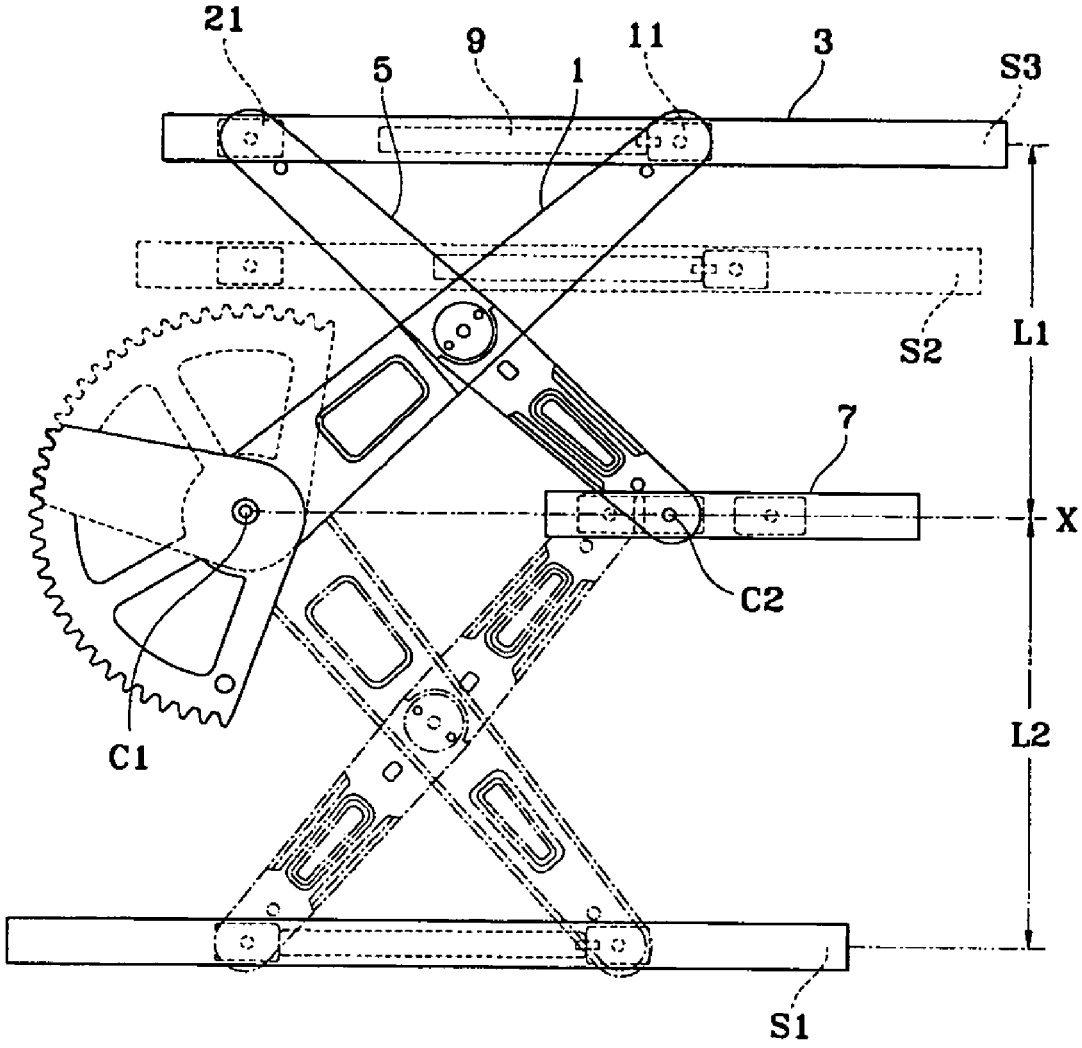
FIG. 4 is a schematic drawing for illustrating an operation of a door window glass regulator assembly for a vehicle according to an embodiment of the present invention.

As illustrated in FIG. 4, L2 which downwardly covers a maximum distance from a straight line (X) to the glass rail 3 is longer than L1 which upwardly covers a maximum distance from the straight line (X) to the glass rail 3, where the straight line (X) is a line connecting a rotating axle (C1) of the lifting arm 1 to a rotating axle (C2) formed between the auxiliary arm 5 and the support rail 7.

One of the two sliders (in the present invention, the slider between the lifting arm 1 and the glass rail 3 is referred to as a connecting slider, while the remaining slider is referred to as an independent slider) is connected to the stop bar 9 via connecting means.

Figure 2:
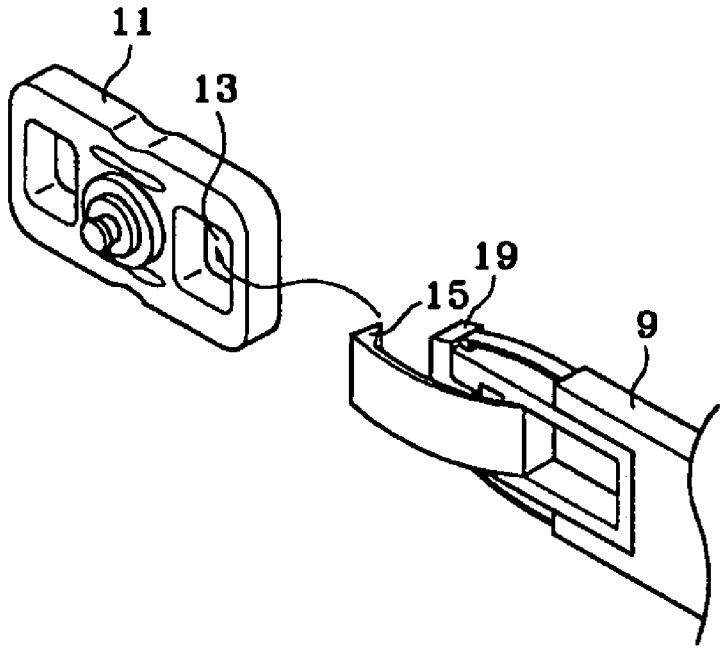
FIG. 2 is an exploded view of a slider and a stop bar of FIG. 1.
Figure 3:
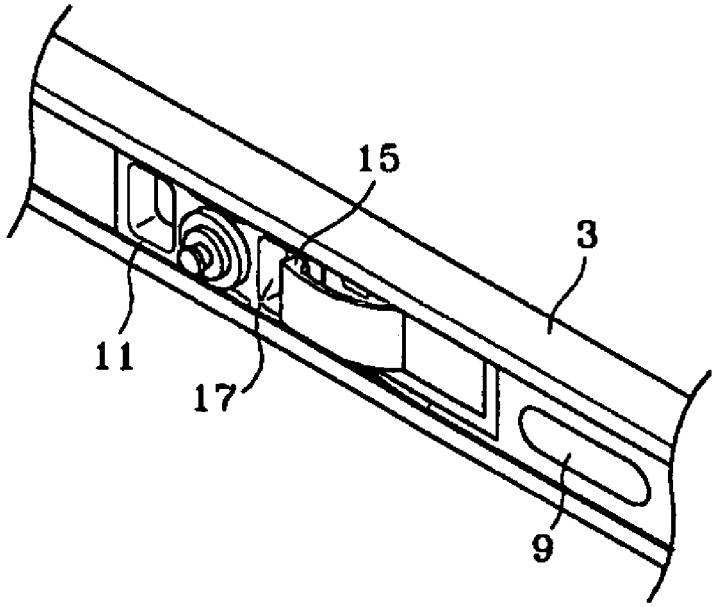
FIG. 3 is an assembled view of a slider connected to a stop bar of FIG. 2.

Referring to FIGS. 2 and 3, one exemplary connecting means of the present invention includes a hitching hole 13 formed at the connecting slider 11 and a hitching lug 15 formed at the stop bar 9 so as to be inserted into the hitching hole 13 and to allow the connecting slider 11 and the stop bar 9 to be integrated.

The stop bar 9 and the connecting slider 11 may be integrated while the hitching lug 15 is hitched at the hitching hole 13 such that the stop bar 9 and the connecting slider 11 integrally and linearly slide from the glass rail 3 when the window ascends.

The hitching lug 15 may be integrally formed as in the embodiment of the present invention, but may connect a hole separately formed at the stop bar 9 and the hitching hole 13 of the connecting slider 11 by being manufactured in a separate part. The stop bar 9 may be mounted at a distal end thereof with a damper pad 19 which functions as a buffer when the stop bar 9 and the slider come into contact therebetween.

Next, the operation of the door window glass regulator assembly for a vehicle thus constructed will be described, where S denotes a step.

When the window is completely opened, in other words, when the glass rail 3 is fully lowered, the independent slider 21 and the damper pad 19 of the stop bar 9 come into contact therebetween (S1).

In other words, the operation of the window being fully opened is realized by the oppositely linear-sliding independent slider 21 and the connecting slider 11 respectively being abutted to both sides of the stop bar 9.

Even though noise may be generated by the contact between the damper pad 19 of the stop bar 9 and the independent slider 21, this is insignificant because the noise is subtle, generated by the window being lowered.

When the window is raised under the above condition, the independent slider 21 and the connecting slider 11 slide away from one another (i.e., toward mutually distancing directions) to lift the glass rail 3. When the glass rail 3 passes the straight line (X) which connects the rotating axle (C1) of the lifting arm 1 to the rotating axle (C2) formed by the auxiliary arm 5 and the support rail 7, a gap formed by the independent slider 21 and the connecting slider 11 is narrowed to raise the glass rail 3 (refer to S2 of FIG. 4).

The connecting slider 11 and the stop bar 9 cannot be structurally touched therebetween because the stop bar 9 integrally moves with the connecting slider 11 such that there is no generation of unwanted noise from the connecting slider 11 and the stop bar 9.

Furthermore, the independent slider 21 and the damper pad 19 at the stop bar 9 do not meet each other until the window is completely raised (refer to S3 of FIG. 4). This is because the state of the window being fully raised to reach a zone of no-further-vertical-movement is realized, not by the contact between the stop bar 9 and the independent slider 21, but by a mechanism where the window itself touches an uppermost portion of the door to reach the zone of no-further-vertical-movement before the stop bar 9 and the independent slider 21 are mutually in contact therebetween.

In other words, it is because line L2 downwardly covering the maximum distance from the straight line (X) to the glass rail 3 is longer than line L1 upwardly covering the maximum distance from the straight line (X) to the glass rail 3, where the straight line (X) is a line connecting a rotating axle (C1) of the lifting arm 1 to a rotating axle (C2) formed by the auxiliary arm 5 and the support rail 7.

As a result, a door equipped with a door window glass regulator assembly for a vehicle thus constructed can maintain a silent operating state because unwanted noise is not generated by the stop bar 9 hitting the sliders.

For the foregoing reasons, the door window glass regulator assembly for a vehicle according to an exemplary embodiment of the present invention may provide a window which can ascend and descend silently by suppressing the generation of unwanted noise, thus providing comfort to the passengers and a feeling of elegance to the vehicle.

What is claimed is:

1. A door window glass regulator assembly for a vehicle comprising:

a lifting arm comprising a rotation point, wherein the lifting arm is rotatable about the rotation point;

a glass rail slidably connected to the lifting arm for effecting vertical movement of the glass rail by rotational motion of the lifting arm;

an auxiliary arm hinged to the lifting arm and slidably connected to the glass rail;

a support rail slidably supporting the auxiliary arm, wherein the auxiliary arm connects to the support rail through a hinge point;

first and second sliders, the first slider slidably connecting the lifting arm to the glass rail, and the second slider slidably connecting the auxiliary arm to the glass rail;

a non-elastic stop bar slidably disposed in said glass rail between the two sliders and having a longitudinal axis generally parallel to a longitudinal axis of said glass rail, said stop bar engaging said sliders when said regulator assembly is in an open position; and at least one connecting element for connecting the non-elastic stop bar to one of the sliders wherein when said regulator assembly is in said open position, said glass rail and said support rail are spaced apart by a first distance and when said regulator assembly is in a closed position, said glass rail and said support rail are spaced apart by a second distance which is less than said first distance.

2. The assembly as defined in claim 1, wherein the at least one connecting element comprises:

a hitching hole in said one of said sliders; and a hitching lug connected to the non-elastic stop bar so as to be inserted into the hitching hole and to allow said one of the sliders and the non-elastic stop bar to be integrated.

3. The assembly of claim 2, wherein the non-elastic stop bar further comprises a damper to buffer contact between the non-elastic stop bar and the one of the sliders.

* * * * *